United States Patent [19]

Masaki

[11] Patent Number: 4,563,693

[45] Date of Patent: Jan. 7, 1986

[54] GRADATION RECORDER

[75] Inventor: Yosuke Masaki, Soma, Japan

[73] Assignee: Alps Electric Co., Ltd., Japan

[21] Appl. No.: 621,437

[22] Filed: Jun. 18, 1984

[30] Foreign Application Priority Data

Jun. 17, 1983 [JP] Japan ..... 58-107943

[51] Int. Cl.[4] ..... B41S 3/02

[52] U.S. Cl. ..... 346/76 PH; 358/298; 400/120

[58] Field of Search ..... 346/76 PH, 76 R; 400/120; 219/216 PA; 358/75, 296, 298; 250/317.1, 318, 316.1

[56] References Cited

U.S. PATENT DOCUMENTS 4,335,968 6/1982 Regnault ..... 346/76 PH 4,443,121 4/1984 Arai ..... 346/76 PH

*Primary Examiner*—Thomas H. Tarcza

*Assistant Examiner*—A. Evans

*Attorney, Agent, or Firm*—Guy W. Shoup

[57] ABSTRACT

A gradation recorder used with a thermal printer that produces image data, such as a television image, in the form of a hard copy. The recorder has shift registers corresponding to the heat-producing resistors in the thermal printer. A plurality of gate drivers have their outputs connected to the respective resistors. A decoder which converts its input in binary form into hexadecimal form is connected to each one input of the shift registers. Data items are successively stored in the shift registers. Then, clock pulses are applied to the shift registers to successively retrieve the stored data items. Every time each one bit of the data is retrieved, the gate drivers energize or de-energize their respective resistors to print one dot matrix having a desired shade or tone.

2 Claims, 4 Drawing Figures

| $14_5$ | $14_4$ | $14_3$ | $14_2$ | $14_1$ | $40_1$ | $40_2$ | $40_3$ | $40_4$ | $40_5$ | $40_6$ | | $40_{32}$ |
|---|---|---|---|---|---|---|---|---|---|---|---|---|
| 0 | 0 | 0 | 0 | 0 | 0 | 1 | 1 | 1 | 1 | 1 | | 1 |
| 0 | 0 | 0 | 0 | 1 | 1 | 0 | 1 | 1 | 1 | 1 | | 1 |
| 0 | 0 | 0 | 1 | 0 | 1 | 1 | 0 | 1 | 1 | 1 | | 1 |
| 0 | 0 | 0 | 1 | 1 | 1 | 1 | 1 | 0 | 1 | 1 | | 1 |
| 0 | 0 | 1 | 0 | 0 | 1 | 1 | 1 | 1 | 0 | 1 | | 1 |
| 0 | 0 | 1 | 0 | 1 | 1 | 1 | 1 | 1 | 1 | 0 | | 1 |
| 0 | 0 | 1 | 1 | 0 | 1 | 1 | 1 | 1 | 1 | 1 | | 1 |
| 0 | 0 | 1 | 1 | 1 | 1 | 1 | 1 | 1 | 1 | 1 | | 1 |
| 0 | 1 | 0 | 0 | 0 | 1 | 1 | 1 | 1 | 1 | 1 | | 1 |
| 0 | 1 | 0 | 0 | 1 | 1 | 1 | 1 | 1 | 1 | 1 | | 1 |
| 0 | 1 | 0 | 1 | 0 | 1 | 1 | 1 | 1 | 1 | 1 | | 1 |
| 0 | 1 | 0 | 1 | 1 | 1 | 1 | 1 | 1 | 1 | 1 | | 1 |
| 0 | 1 | 1 | 0 | 0 | 1 | 1 | 1 | 1 | 1 | 1 | | 1 |
| 0 | 1 | 1 | 0 | 1 | 1 | 1 | 1 | 1 | 1 | 1 | | 1 |
| 0 | 1 | 1 | 1 | 0 | 1 | 1 | 1 | 1 | 1 | 1 | | 1 |
| 0 | 1 | 1 | 1 | 1 | 1 | 1 | 1 | 1 | 1 | 1 | | 1 |
| ⋮ | ⋮ | ⋮ | ⋮ | ⋮ | ⋮ | ⋮ | ⋮ | ⋮ | ⋮ | ⋮ | | ⋮ |
| 1 | 1 | 1 | 1 | 0 | 1 | 1 | 1 | 1 | 1 | 1 | | 1 |
| 1 | 1 | 1 | 1 | 1 | 1 | 1 | 1 | 1 | 1 | 1 | | 0 |

GRADATION RECORDER

FIELD OF THE INVENTION

The present invention relates to a gradation recorder and, more particularly, to a recorder used with a thermal printer, for example, which produces image data such as a television image in the form of a hard copy, for obtaining printed images having desired tones or shades by controlling the time that a voltage is applied to the heat-producing resistors.

BACKGROUND OF THE INVENTION

In known thermal printers where the shades or tones of printed dots are controlled, the voltage or current applied to heat-producing resistors or the time it is applied is varied. Of these devices, those printers where the voltage or current is controlled result in an increase in the power supply capacity and need a complicated circuitry to adjust the voltage or current. Also, known printers which control the time using analog devices, such as monostable multivibrators, tend to produce less accurate shades than printers generating dots which can have 8 to 16 discrete shade variations.

SUMMARY OF THE INVENTION

In view of the foregoing, it is the main object of the present invention to provide a gradation recorder which controls the shades of printed dots by adjusting the time a voltage or current is applied, which performs all the operations digitally and has a simplied circuit for driving the thermal head, and which prints high-quality characters, or the like.

Other objects and features of the invention will appear in the course of description thereof which follows.

DETAILED DESCRIPTION OF THE DRAWINGS

All the figures show or pertain to a gradation recorder according present invention, and in which.

Figures 1, 2:
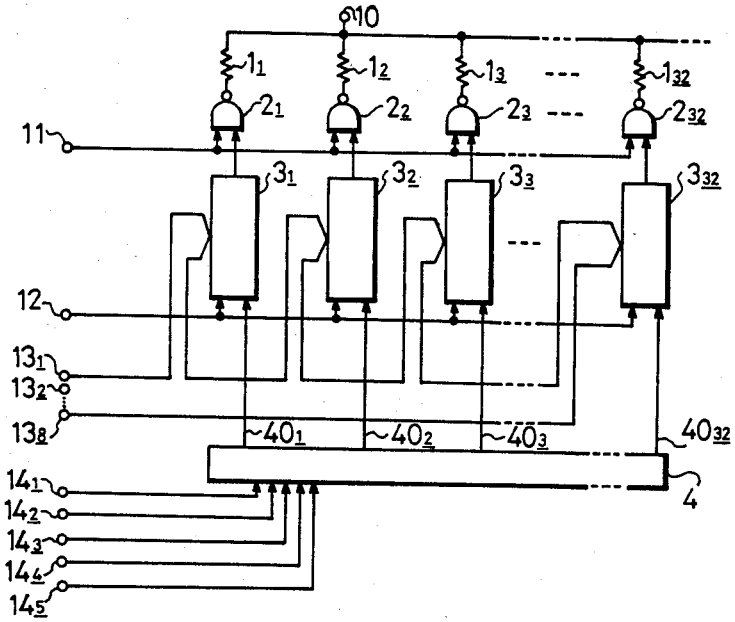
FIG. 1 is a block diagram of the recorder.
FIG. 2 is a table for describing the operations of the decoder in the recorder shown in FIG. 1.
Figure 3A:
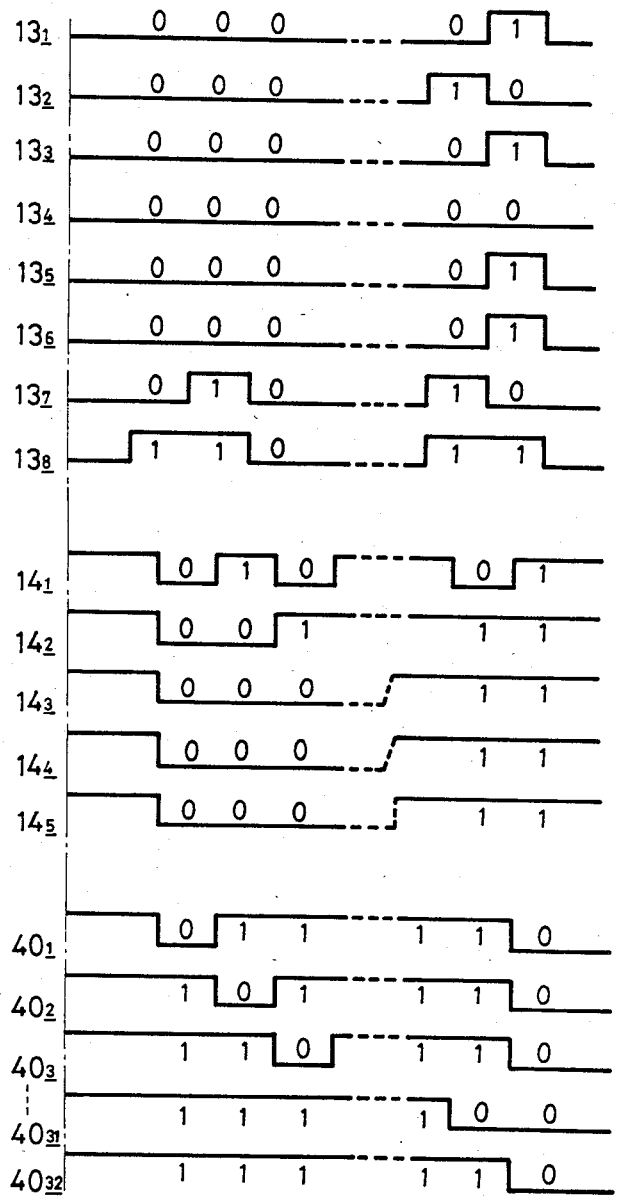
Figure 3:
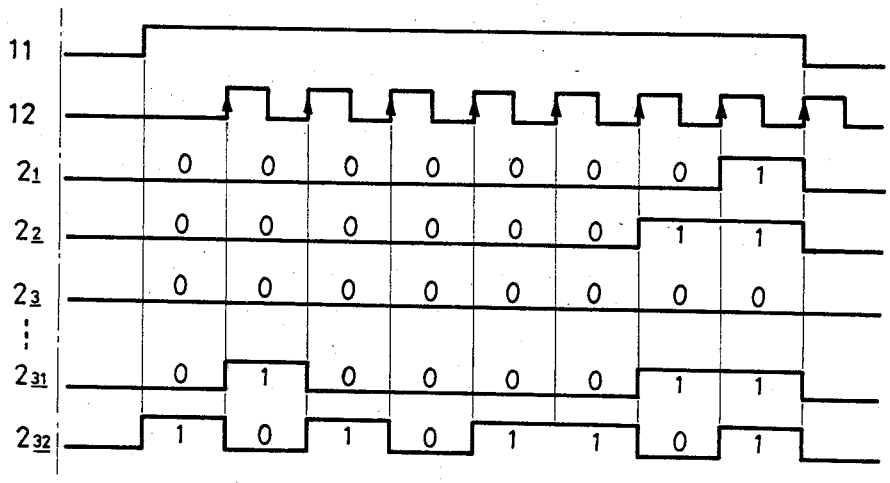

FIG. 3 (*a*) and 3 (*b*) are time charts for illustrating the operations of the recorder shown in FIG. 1.

DETAILED DESCRIPTION OF THE INVENTION

Referring now to FIG. 1, there is shown a gradation recorder which is fabricated in accordance with the teachings of the present invention and which is equipped with a thermal head acting to perform a printing operation by means of a 32 dot matrix. The recorder is shown having heat-producing resistors $\mathbf{1}_1$–$\mathbf{1}_{32}$, each one end of which is connected to a power supply terminal 10. Gate drivers $\mathbf{2}_1$–$\mathbf{2}_{32}$ have their one output terminals connected to the other ends of the resistors $\mathbf{1}_1$–$\mathbf{1}_{32}$. A gate-enabling terminal 11 is connected to each one input terminal of the drivers $\mathbf{2}_1$–$\mathbf{2}_{32}$. Disposed corresponding to the resistors $\mathbf{1}_1$–$\mathbf{1}_{32}$ are shift registers $\mathbf{3}_1$–$\mathbf{3}_{32}$, the output terminals of which are connected to the other input terminals of the gate drivers $\mathbf{2}_1$–$\mathbf{2}_{32}$. The shift registers are supplied with clock pulses tnrough a clock terminal 12, and receive data items througn data input terminals $\mathbf{13}_1$–$\mathbf{13}_8$. The externally applied clock pulses cause the shift registers $\mathbf{3}_1$–$\mathbf{3}_{32}$ to convert digital signals in parallel form into serial form. For example, the input terminals $\mathbf{13}_1$–$\mathbf{13}_8$ successively receive data items in the 8-bit form from a storage device (not shown), in which data items are stored in binary form such that the data items represent the shades corresponding to the amplitude level of a video signal. The recorder further includes a decoder 4, which operates on the principle indicated by the truth table shown in FIG. 2 and performs a binary-to-hexadecimal conversion. In particular, the decoder causes only one of its output terminals $\mathbf{40}_1$–$\mathbf{40}_{32}$ to assume "0" level, the one terminal being determined by the binary signals applied at select signal terminals $\mathbf{14}_1$–$\mathbf{14}_5$.

In the construction thus far described, when a signal coded as "10000000" is fed to the input terminals $\mathbf{13}_1$–$\mathbf{13}_8$ and a signal coded as "00000" is furnisned to the select signal terminals $\mathbf{14}_1$–$\mathbf{14}_5$, only the output terminals $\mathbf{40}_1$ of the decoder 4 assumes "0" level and so the piece of data "10000000" is stored in the shift register $\mathbf{3}_1$. Similarly, when a signal coded as "11000000" is applied to the input terminals $\mathbf{13}_1$–$\mathbf{13}_8$ and a signal coded as "00001" is provided to rhe select signal terminals $\mathbf{14}_1$–$\mathbf{14}_5$, the piece of data "11000000" is stored in the shift register $\mathbf{3}_2$. In this way, data items are successively stored in the shift registers $\mathbf{3}_3$–$\mathbf{3}_{32}$ by applying the signals to be stored in the shift registers at the input terminals $\mathbf{13}_1$–$\mathbf{13}_8$ and applying the signals for selecting the corresponding shift registers at the select signal terminals $\mathbf{14}_1$–$\mathbf{14}_5$. Tne manner in which the data items are stored in the shift registers $\mathbf{3}_1$–$\mathbf{3}_{32}$ is shown in the time chart of FIG. 3 (*a*).

Tne data items stored in the shift registers $\mathbf{3}_1$–$\mathbf{3}_{32}$ as described above excite the heat-producing resistors $\mathbf{1}_1$–$\mathbf{1}_{32}$ in the manner shown in the time chart of FIG. 3 (*b*). More specifically, after certain data items have been stored in the shift registers, the signal appearing at the gate-enabling terminal 11 is caused to taken on "1" level, thus enabling the gate drivers $\mathbf{2}_1$–$\mathbf{2}_{32}$ to deliver 1 bit of signal. Then, the outputs of some of the gate drivers $\mathbf{2}_1$–$\mathbf{2}_{32}$ assume "0" level, while the outputs of the other drivers take up "1" level. The resistors corresponding to the gate drivers assuming "1" level are heated. After an elapse of a certain time from the beginning of the supply of "1" level signal to the gate-enabling terminal 11, the clock terminal 12 delivers a clock pulse to the shift registers $\mathbf{3}_1$–$\mathbf{3}_{32}$ to renew their contents by one bit. The renewed data items are then delivered so that some of the gate drivers $\mathbf{2}_1$–$\mathbf{2}_{32}$ may produce "0" level signal and the others may produce "1" level signal, similarly to the foregoing. Only the resistors corresponding to the gate drivers taking on "1" level are energized and caused to generate heat. In this fasnion, eignt pulses in total are successively input to extract all the data items contained in the shift registers $\mathbf{3}_1$–$\mathbf{3}_{32}$. The result is that one dot matrix is formed by the resistors $\mathbf{1}_1$–$\mathbf{1}_{32}$ such that it has a given shade. After the completion of the printing of the dot matrix, the gate-enabling terminal 11 assumes "0" level, and the gate drivers $\mathbf{2}_1$–$\mathbf{2}_{32}$ are disenabled.

According to the novel apparatus as hereinbefore described, the control over the time during which the heatproducing registers are energized is performed fully digitally, and therefore image information can be printed in plural tones or shades with quite high fidelity. Further, since the apparatus uses the shift registers, the storage of data as well as the delivery of a single pulse from each shift register can readily be controlled with a microcomputer. It is also possible to add another hard-wired logic to produce the aforementioned single pulse, in which case the microcomputer is freed from this operation and hence it can perform other processes, whereby contributing greatly to an improvement in the throughput of the system.

Obviously many modifications and variations of the present invention are possible in the light of the above teachings. It is therefore to be understood that within the scope of the appended claims the invention may be practiced otherwise than as specifically described.

What is claimed is:

1. A gradation recorder comprising:

a plurality of shift registers corresponding to a plurality of heat-producing resistors in a thermal head, each shift register having an enabling terminal for receipt of an enabling bit signal to enable said shift register to store a plural-bit binary gradation signal therein, a decoder for decoding a plural-bit binary address signal into a second address signal having a number of bits corresponding to said plurality of shift registers, said decoder including a corresponding plurality of connections to said enabling terminals of said shift registers, means for supplying a series of plural-bit binary gradation data to all shift registers simultaneously in parallel which indicate the shades of the dots forming a character, or the like, to be printed by said resistors of said thermal head through successive bit signals supplied by said shift registers, and means for supplying a series of binary address signals to said decoder to be decoded into second address signals providing bit signals for enabling each shift register in series to store a binary gradation data supplied by said supplying means, the data stored in the shift registers being successively retrieved by applying clock pulses to the shift registers such that the resistors are successively energized or de-energized selectively corresponding to the delivery of each one bit of the data from the shift registers, thereby performing printing using a plurality of shades.

2. A gradation recorder as set forth in claim 1, wherein each of said resistors is energized for a fraction of a given printing time.

* * * * *